US007440581B2

(12) United States Patent
Wiener

(10) Patent No.: US 7,440,581 B2
(45) Date of Patent: Oct. 21, 2008

(54) BACKPACK WITH INTEGRATED SPEAKERS

(75) Inventor: David Wiener, Park City, UT (US)

(73) Assignee: Soundtube Entertainment, Inc., Park City, UT (US)

( * ) Notice: Subject to any disclaimer, the term of this patent is extended or adjusted under 35 U.S.C. 154(b) by 292 days.

(21) Appl. No.: 11/379,853

(22) Filed: Apr. 24, 2006

(65) Prior Publication Data

US 2006/0251284 A1 Nov. 9, 2006

Related U.S. Application Data

(62) Division of application No. 09/548,031, filed on Apr. 12, 2000, now Pat. No. 7,035,422.

(51) Int. Cl.
*H04R 5/02* (2006.01)
*H04R 1/02* (2006.01)

(52) U.S. Cl. ..... 381/388; 381/301

(58) Field of Classification Search ..... 381/301, 381/304, 305, 333, 334, 335, 385, 388; 2/209.13, 2/250; 361/600, 679, 683; 379/430; 224/153, 224/259, 576
See application file for complete search history.

(56) References Cited

U.S. PATENT DOCUMENTS

| | | | | |
|---|---|---|---|---|
| 2,156,504 | A | | 5/1939 | Liss |
| 2,285,083 | A | | 6/1942 | Cover |
| 3,440,635 | A | | 4/1969 | Hull |
| 3,835,265 | A | | 9/1974 | Itagaki |
| 3,873,784 | A | | 3/1975 | Doschek |
| 4,041,394 | A | | 8/1977 | Pate |
| 4,070,553 | A | | 1/1978 | Hass |
| 4,084,139 | A | | 4/1978 | Jakobe |
| 4,124,249 | A | | 11/1978 | Abbeloos |
| 4,322,585 | A | * | 3/1982 | Liautaud ..... 381/385 |
| 4,343,158 | A | | 8/1982 | Campbell |
| 4,471,172 | A | | 9/1984 | Winey |
| 4,485,276 | A | | 11/1984 | Sato |
| 4,490,842 | A | | 12/1984 | Watanabe |
| 4,507,816 | A | | 4/1985 | Smith |
| 4,539,700 | A | | 9/1985 | Sato |
| 4,589,134 | A | | 5/1986 | Waldron |
| 4,603,327 | A | | 7/1986 | Leonard et al. |
| 4,638,884 | A | | 1/1987 | Lee |
| 4,641,345 | A | | 2/1987 | Takahashi |
| 4,750,208 | A | | 6/1988 | Yamada et al. |
| 4,758,047 | A | | 7/1988 | Hennington |
| 4,763,362 | A | | 8/1988 | Eure |
| 4,860,363 | A | | 8/1989 | Suzuki et al. |
| 4,860,364 | A | | 8/1989 | Giannini |

(Continued)

OTHER PUBLICATIONS

Contest advertisement form GQ magazine for AT&T Future Style, portraying designer outfits outfitted with a phone on the sleeve, 1994.

(Continued)

*Primary Examiner*—Brian Ensey
(74) *Attorney, Agent, or Firm*—Gordon and Jacobson, PC

(57) ABSTRACT

The personal wearable speaker system includes a backpack having a plurality of substantially hollow tubular ducts formed from a substantially flexible material designed to promote superior sound wave flow and anti-collapse (pinch) functionality, and a plurality of pairs of sound transducers.

15 Claims, 8 Drawing Sheets

U.S. PATENT DOCUMENTS

| | | | | |
|---|---|---|---|---|
| 4,876,724 | A | | 10/1989 | Suzuki |
| 4,951,910 | A | | 8/1990 | March |
| 5,091,992 | A | | 3/1992 | Pusic |
| 5,115,472 | A | | 5/1992 | Park et al. |
| 5,143,055 | A | | 9/1992 | Eakin |
| 5,147,969 | A | | 9/1992 | Hiyoshi et al. |
| 5,148,002 | A | | 9/1992 | Kuo et al. |
| 5,212,734 | A | | 5/1993 | Tsao |
| 5,290,964 | A | | 3/1994 | Hiyoshi et al. |
| 5,297,214 | A | | 3/1994 | Bruney |
| 5,309,519 | A | | 5/1994 | Park et al. |
| 5,314,403 | A | | 5/1994 | Shaw |
| 5,353,261 | A | | 10/1994 | Kakiuchi et al. |
| 5,368,359 | A | | 11/1994 | Eakin |
| 5,398,992 | A | | 3/1995 | Daniels |
| 5,409,152 | A | * | 4/1995 | Trevino ..... 224/576 |
| 5,530,626 | A | | 6/1996 | Norment |
| 5,553,148 | A | | 9/1996 | Werle |
| 5,563,951 | A | | 10/1996 | Wang et al. |
| 5,651,485 | A | | 7/1997 | Impastato, II |
| 5,682,434 | A | | 10/1997 | Boyden |
| 5,687,246 | A | | 11/1997 | Lancon |
| 5,757,929 | A | | 5/1998 | Wang et al. |
| 5,774,338 | A | | 6/1998 | Wessling, III |
| 5,784,473 | A | | 7/1998 | Ferren |
| 5,815,579 | A | * | 9/1998 | Boyden ..... 381/301 |
| 5,881,160 | A | | 3/1999 | Sheppard |
| 5,953,434 | A | | 9/1999 | Boyden |
| 6,015,119 | A | | 1/2000 | Starchevich |
| 6,301,367 | B1 | | 10/2001 | Boyden et al. |
| 6,311,933 | B1 | | 11/2001 | Starchevich |
| D469,952 | S | | 2/2003 | Daglow et al. |
| 6,712,249 | B2 | | 3/2004 | Magnusson et al. |
| 6,883,693 | B2 | | 4/2005 | Han |

OTHER PUBLICATIONS

Sound system for the deaf design in I.D. Annual Design Review, p. 172, 1999.

* cited by examiner

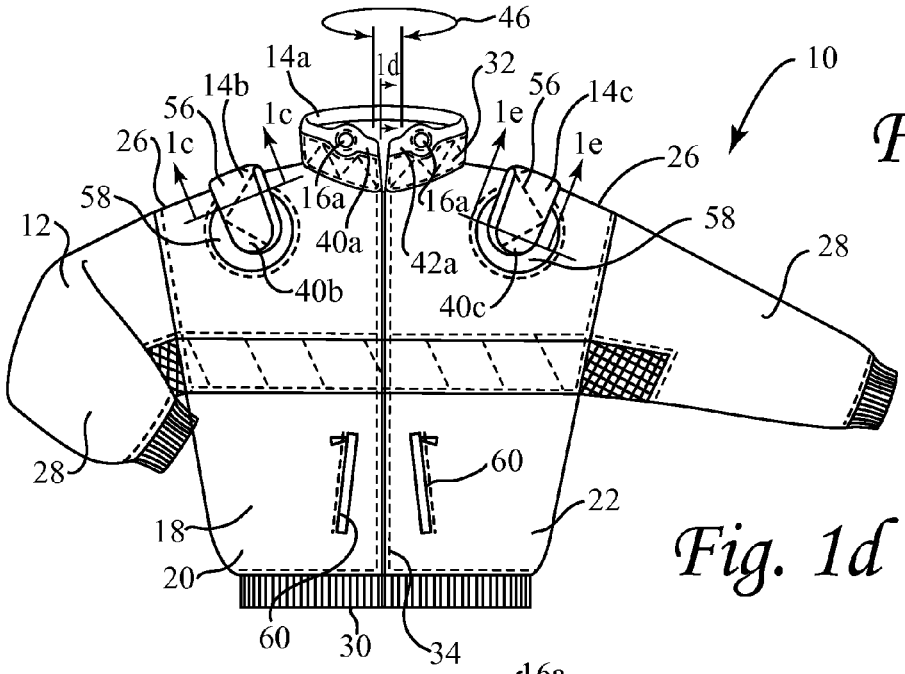
Fig. 1a
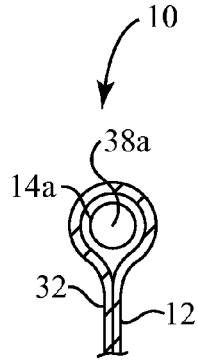
Fig. 1d
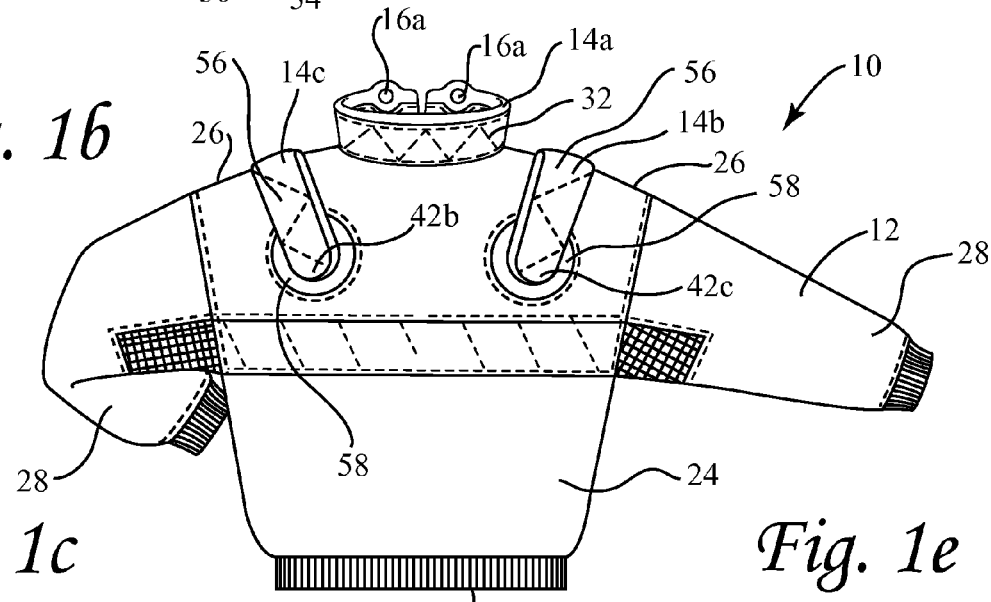
Fig. 1b
Fig. 1c
Fig. 1e
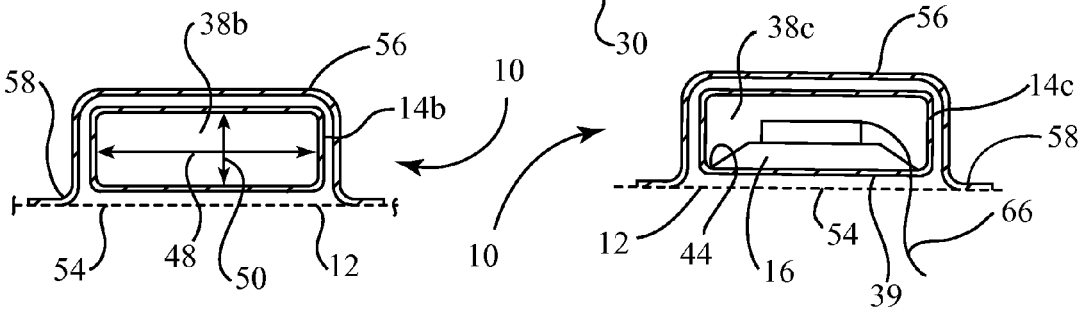

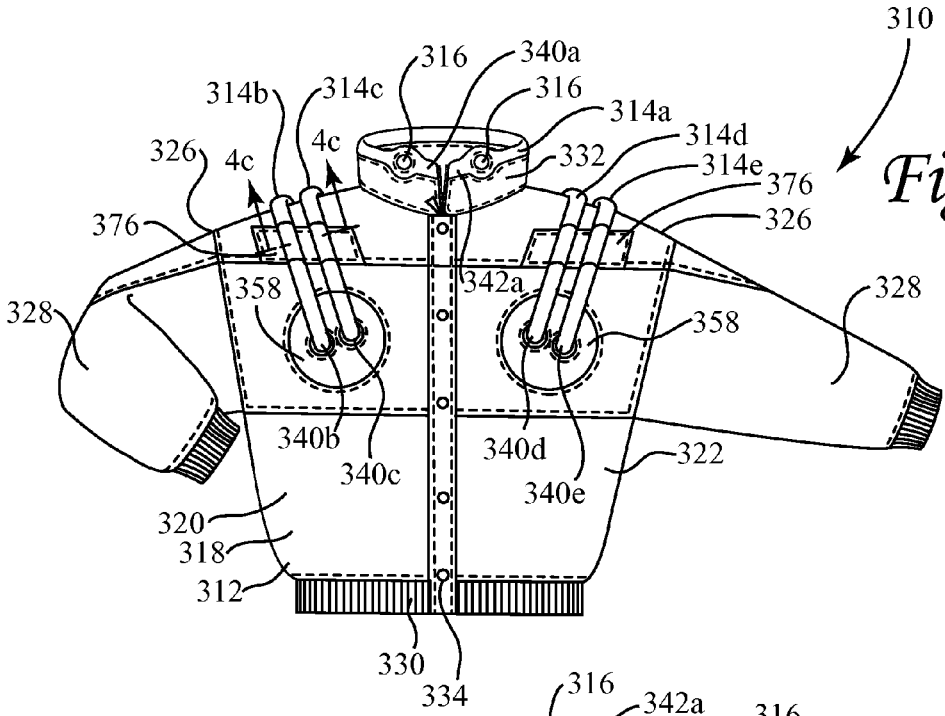
Fig. 4a
Fig. 4b
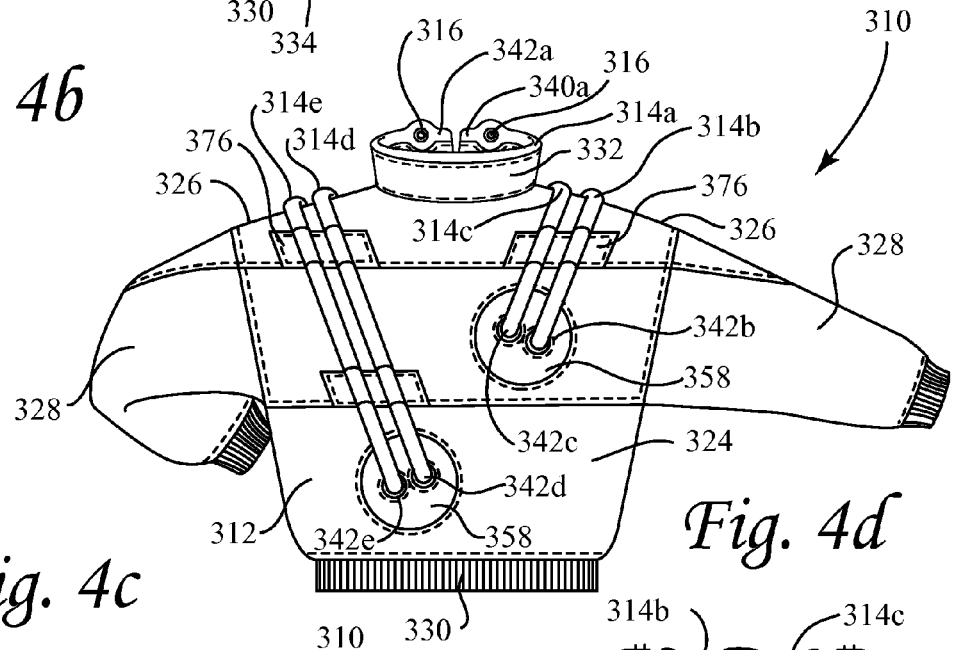
Fig. 4d
Fig. 4c
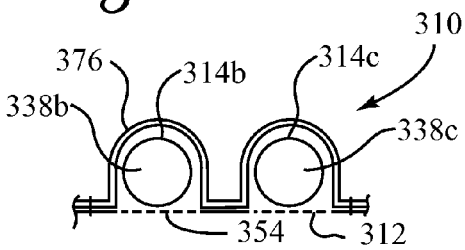
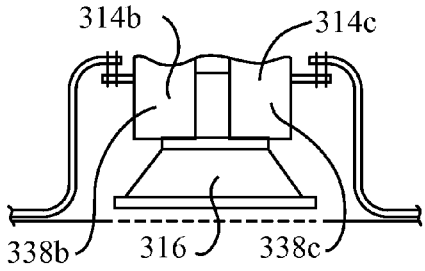

BACKPACK WITH INTEGRATED SPEAKERS

This application is a divisional of U.S. Ser. No. 09/548,031, filed Apr. 12, 2000 now U.S. Pat. No. 7,035,422, which is hereby incorporated by reference herein in its entirety.

BACKGROUND OF THE INVENTION

1. Field of the Invention

This invention relates broadly to audio speakers. More particularly, this invention relates to wearable speakers.

2. State of the Art

Audiophiles and non-audiophiles alike often desire to have music available for listening wherever they may be or whatever they are doing (e.g. while jogging, biking, exercising, or walking). Because of the demand, there exist many portable audio systems designed for personal use, (e.g., Sony Walkman® and similar types of CD and tape players, DVD players, cell phones and other types of signal sources). Most if not all of the portable personal audio systems incorporate the use of headphones or earphones to transmit sound to the listener's ear. However, earphones and headphones are often uncomfortable to wear for long periods of time, are not an attractive fashion statement, can become dislodged as a result of physical activity, and can block or attenuate environmental sounds compromising the wearer's safety. Further, because of size and weight constraints, mounting traditionally sized speakers on clothing would not be feasible.

U.S. Pat. Nos. 5,682,434, 5,815,579, and 5,953,434 all to Boyden attempt to address these problems. U.S. Pat. No. 5,682,434 discloses a wearable speaker formed by mounting transducers into a thin flat narrow dual cavity structure which can be mounted on a garment of a listener. The speaker enclosure can also be worn like a pendant or collar around the neck of the listener thereby eliminating the need for earphones or headphones. U.S. Pat. No. 5,815,579 discloses a wearable speaker adapted to be applied as a collar, yolk, or epaulet of a garment. The enclosure is formed as a thin narrow hollow (or open-celled foam filled) enclosure which may be open to the atmosphere at one or more ends. Likewise, U.S. Pat. No. 5,953,434 discloses a thin narrow strip of cloth or open-celled foam having two speakers which is designed to be worn as a head band around the head of a listener. Because of the nature of thin narrow enclosures of the above referenced patents, the speaker chamber volumes formed by the enclosures are necessarily small and thereby provide reduced sound quality from the speakers especially in the lower frequency range. For example, U.S. Pat. Nos. 5,815,579 and 5,953,434 describe an enclosure structure having a nearly four to one dimensional ratio of width to thickness. Because of the relatively large dimensional ratio of width to thickness of the prior art references, unless the enclosures are formed from substantially rigid materials, the chambers can easily be pinched off (and thereby further reduced in effective size) as the thin narrow enclosures will flex and bend as the wearer moves and flexes and bends the article of clothing. On the other hand, if the enclosures are in fact rigid, they are uncomfortable to wear and will considerably restrict movement of the wearer. Further, the prior art enclosures are designed to be worn as close to the ear of the wearer as possible having the sound transducers positioned such that they direct sound toward the wearer's ear, which may not be a desirable or advantageous placement on a garment.

SUMMARY OF THE INVENTION

It is therefore an object of the invention to provide a wearable personal speaker system which can be incorporated into a garment e.g, a coat, vest, shirt, tank-top, shawl, t-shirt, scarf, sweater, blouse, pants, or jacket of a wearer.

It is another object of the invention to provide a wearable personal speaker system which has a chamber volume sized to enhance low frequency response.

It is a further object of the invention to provide a wearable personal speaker system which does not interfere with the activity of the wearer and which does not block environmental sounds.

It is an additional object of the invention to provide a wearable personal speaker system with enhanced low frequency response which provides a physical sensation to the body of the wearer.

In accord with these objects, which will be discussed in detail below, a personal speaker system is incorporated into a garment of the wearer. The personal wearable speaker system includes a garment having a plurality of substantially flexible tubular ducts mounted to the garment, and a plurality of pairs of sound transducers mounted to the ducts. The plurality of ducts each have a first end and a second end and each defines a chamber therebetween. Each of the ducts may define a transducer aperture designed to house sound transducers. The ducts each have a first dimension or length, a second dimension or width which is perpendicular to the length, and a third dimension or height which is perpendicular to both the length and the second dimension. It is preferable that the ducts have a width to height ratio of three to one or less to help prevent pinch-off of the chamber. Alternately, the ducts may be provided with one or more undulating surfaces (as disclosed in parent application U.S. Ser. No. 09/504,265) which increase flexibility and better prevent pinch-off.

According to a first embodiment, the garment is a jacket having a front, a back, a pair of shoulders, a pair of sleeves, a wasteband, a pair of zippered pockets near the wasteband, and a collar. The speaker system includes first, second, and third ducts each having a first end and a second end which are mounted to the jacket and each forming a chamber within each of the ducts. The first duct is defined by the collar of the jacket and has a first end and a second end which are closed by the collar. The first ends of the second and third ducts are attached to the front of the jacket, and the second ends of the second and third ducts are attached to the back of the jacket. If desired, each of the second and third ducts may cross one of the shoulders of the jacket. Securing rings coupled to the second and third ducts are preferably used to facilitate the connection between the ends of the ducts and the jacket. The first pair of sound transducers are positioned within the collar such that when the jacket is worn by a wearer, the transducers project sound outward toward an ear of the wearer. Preferably, high frequency sound transducers are mounted in the first duct. In contrast, low frequency sound transducers are positioned within the second and third ducts. In this manner, sound emanating from the front portions of the transducers projects inward toward the body of the wearer and imparts a vibrational component upon the wearer which enhances perception of the low frequency output. Zippered pockets near the wasteband are adapted to receive a player. Wires coupled to the sound transducers run through a lining of the jacket and connect to speaker jacks which connect the sound transducers to the player held within the pocket.

According to other embodiments of the invention, the speaker system may be provided on other types of garments including a shirt, vest, coat, or on a wearable object such as a backpack. Further, the garment may include any number of ducts adapted to receive any number or size of sound transducers. The ducts may also be formed having any shape, size, or cross-section, provided the dimensional ratio of the ducts is no larger than three to one, or the ducts have a height of at least 0.25 inches, or provided the flexible ducts have one or more undulating front surfaces which allow the ducts to bend and flex with the movement of the wearer without pinching off the chamber. Sound ports may further be provided along the ducts to relieve back pressure within the chambers and to provide a port for dissemination of sound.

Additional objects and advantages of the invention will become apparent to those skilled in the art upon reference to the detailed description taken in conjunction with the provided figures.

BRIEF DESCRIPTION OF THE DRAWINGS

FIG. 1*a* is a perspective view of a front of a first embodiment of a personal wearable speaker system coupled to a garment;

FIG. 1*b* is a perspective view of a back of the first embodiment of the personal wearable speaker system of FIG. 1*a;*

FIG. 1*c* is a cross-sectional view of one duct of FIG. 1*a* taken along line 1*c*-1*c;*

FIG. 1*d* is a cross-sectional view of another duct of FIG. 1*a* taken along line 1*d*-1*d;*

FIG. 1*e* is a cross-sectional view of a third duct of FIG. 1*a* taken along line 1*e*-1*e;*

FIG. 4*a* is a perspective view of a front of a fourth embodiment of a personal wearable speaker system coupled to a garment;

FIG. 4*b* is a perspective view of a back of the fourth embodiment of the personal wearable speaker system of FIG. 4*a;*

FIG. 4*c* is a cross-sectional view of a first pair of ducts of FIG. 4*a* taken along line 4*c*-4*c;*

FIG. 4*d* is a broken cross-sectional view of a first pair of ducts of an alternate fourth embodiment;

DETAILED DESCRIPTION OF THE PREFERRED EMBODIMENTS

Figure 2A:
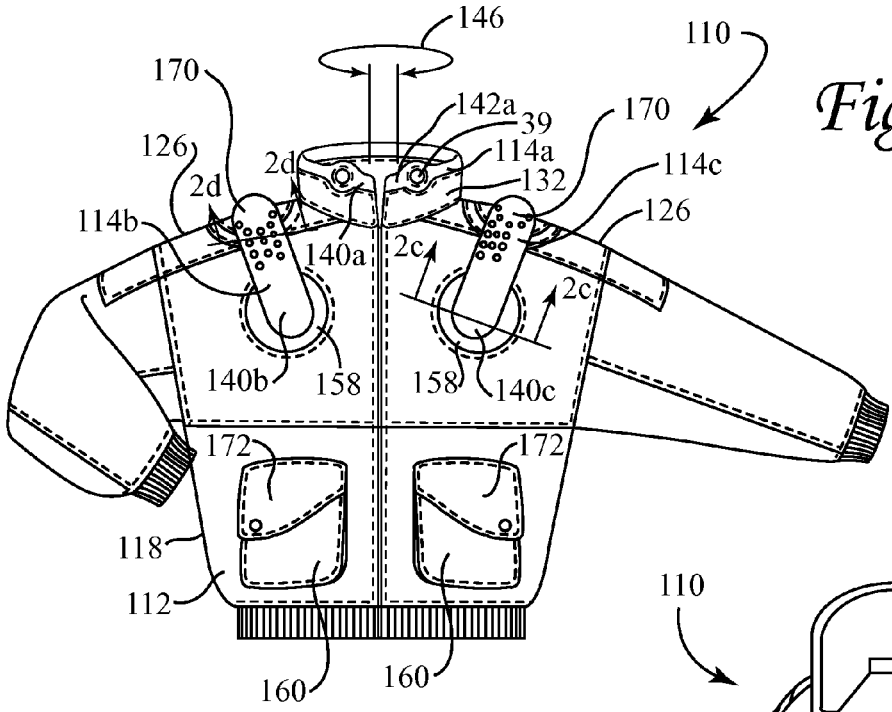
FIG. 2*a* is a perspective view of a front of a second embodiment of a personal wearable speaker system coupled to a garment.
Figure 2C:
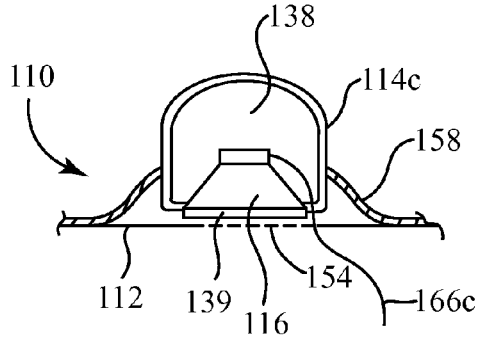
FIG. 2*c* is a cross-sectional view of one duct of FIG. 2*a* taken along line 2*c*-2*c;*
Figure 2D:
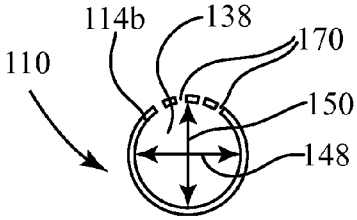
FIG. 2*d* is a cross-sectional view of another duct of FIG. 2*a* taken along line 2*d*-2*d;*
Figure 2B:
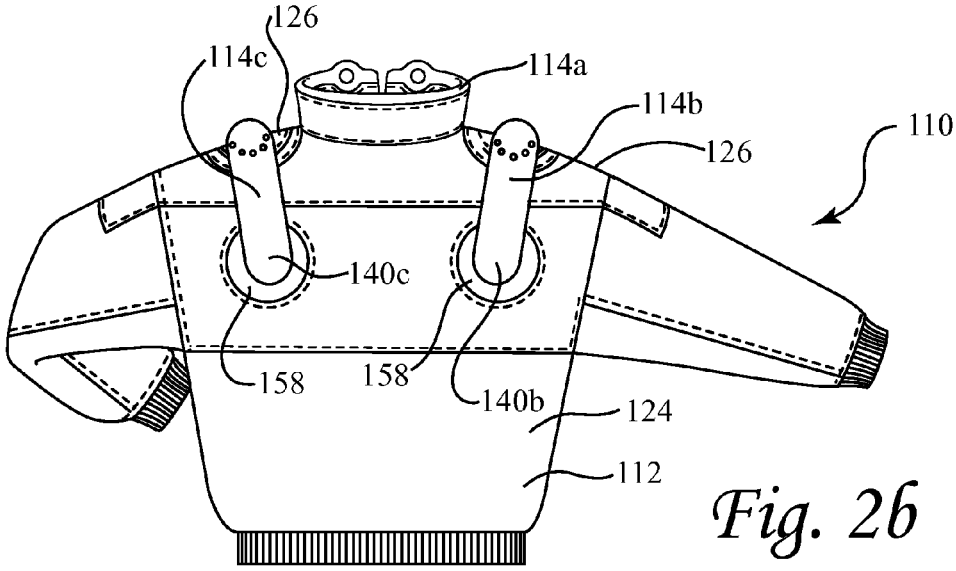
FIG. 2*b* is a perspective view of a back of the second embodiment of the personal wearable speaker system of FIG. 2*a;*

Turning now to FIGS. 1*a*, 1*b*, 1*c*, 1*d*, and 1*e*, a first embodiment of a personal wearable speaker system 10 of the invention is shown attached to a garment 12. The speaker system 10 has a plurality of tubular ducts 14 coupled to the garment 12, and a plurality of sound transducers 16 coupled to the ducts 14. The garment 12 is a jacket having a front 18 formed as a first front panel 20 and a second front panel 22, a back 24, a pair of shoulders 26 formed at the junction of the front 18 and back 24, a pair of sleeves 28, a wasteband 30, and a collar 32. A zipper type fastener 34 sewn onto the jacket 12 detachably connects the front panels 20, 22. The speaker system 10 includes a first duct 14*a* defining a first chamber 38*a*, a second duct 14*b* defining a second chamber 38*b*, and a third duct 14*c* defining a third chamber 38*c*. Preferably, the ducts 14*a*, 14*b*, 14*c* are formed from a flexible material such as polyethylene, PVC, or ABS which will allow them to bend and flex with the garment 12 as the garment 12 bends and folds so that they are comfortable to wear as a wearer moves. Each of the ducts 14*a*, 14*b*, 14*c* has a first end 40*a*, 40*b*, 40*c* and a second end 42*a*, 42*b*, 42*c*. An aperture 44 or hole which receives a transducer 16 is provided at or near each of the ends 40, 42 of the ducts. Each of the ducts 14*a*, 14*b*, 14*c* has a set of dimensions including a first dimension or length 46, a second dimension or width 48 which is perpendicular to the length 46, and a third dimension or height 50 which is perpendicular to both the length 46 and the second dimension 48. Each of the ducts 14*a*, 14*b*, 14*c* has a width to height ratio of not more than approximately three to one or a height of at least 0.25 inches. The width to height ratio of the flexible ducts helps prevent the chambers 38*a*, 38*b*, 38*c* from being pinched off as the ducts 14*a*, 14*b*, 14*c* bend and flex, thereby preventing an otherwise adverse affect to the sound quality output from the speaker system 10. In the first embodiment of the invention, the width and height dimensions of the first duct 14*a* are smaller than the width and height dimensions of the second and third ducts 14*b*, 14*c*, while ducts 14*b*, 14*c* have substantially identical dimensions. In the first embodiment, the dimensions of the first duct 14*a* are preferably 0.5 inches by one inch by fifteen inches and the dimensions of the second and third ducts 14*b*, 14*c* are preferably one inch by three inches by twenty inches. Transducers of different thicknesses are accommodated by having a raised portion around the driver.

According to the first embodiment, the first duct 14*a* is formed within the collar 32 of the jacket 12, and preferably has a generally circular cross-section as seen in FIG. 1*d*. The second duct 14*b* and third duct 14*c* of the speaker system 10 are mounted to an exterior of the jacket 12 such that they both cross from the front 18 to the back 24 of the jacket 12 directly across one of the pair of shoulders 26 of the jacket 12. The second duct 14*b* and the third duct 14*c* have substantially rectangular cross-sections with the smaller of the second dimension 48 and third dimension 50 protruding outward from the jacket 12. Further, the second and third ducts 14*b*, 14*c* each have a substantially larger cross-sectional area than does the first duct 14*a*, which allows them to accommodate larger sound transducers 16 within the chambers 38.

Sound transducers 16, which preferably include face plates or baffle surfaces 39 which are wider than the transducer aperture 44, are mounted in the transducer apertures 44 in the ducts 14*a*, 14*b*, 14*c* such that at least a portion of each of the sound transducers 16 are contained within the chambers 38 of the ducts 14. The sound transducers may be mounted within the transducer apertures by adhesive, double sided tape, pins, clips, or other such devices or mechanisms applied to the face plate 39 such that the transducer is securely held within the aperture even when the flexible duct is bent or flexed. Alternately, the sound transducers may be manipulated into place and secured within the transducer apertures by friction fit.

According to the first embodiment of the invention, a pair of high frequency sound transducers 16*a* are preferably mounted in the transducer apertures (not shown) of the first duct 14*a*, and a pair of low frequency sound transducers 16*b* are mounted in the transducer apertures 44 of the second and third ducts 14*b*, 14*c*. The first pair of sound transducers 16*a* are mounted in the first duct 14*a* with the wide portion of the speaker cone opening to the environment so that when the jacket 12 is being worn by a wearer, the soundwaves are projected outwardly toward the ears of the wearer. On the other hand, the sound transducers 16*b*, 16*c* mounted in the second and third ducts 14*b*, 14*c* are preferably mounted with the wide portion of the speaker cone facing the garment and the wearer so that the sound transducer projects soundwaves inward toward a body of the wearer thereby imparting a low frequency vibrational component of the sound wave to the wearer. The vibratory sensation felt by the wearer has been found to increase the wear's perception of the low frequency sound component of the sound wave. The vibrational component may be enhanced and the sound transducer 16 protected by providing the garment with a perforated membrane 54 at the location on the garment 12 adjacent the sound transducers 16 as seen in FIG. 1*e*.

According to the preferred embodiment, decorative covers 56 surround the second and third tubular ducts 14*b*, 14*c*. The covers 56 may be designed to disguise, conceal, or otherwise aesthetically accentuate the ducts 14 as desired. The decorative covers 56 may be formed from any material including a quilted or insulating material which helps direct soundwaves toward the body of the wearer and attenuate any stray soundwaves which might escape outward. Securing rings 58 coupled to the decorative covers 56 surrounding the second and third ducts 14*b*, 14*c* near the ends 40*b*, 40*c*, 42*b*, 42*c* of the ducts 14*b*, 14*c* facilitate the connection between the decorative covers 56 and the jacket 12. The securing rings 58 can be detachably coupled to the jacket 12 (e.g. by snaps, adhesive, or double-sided tape) such that the decorative covers 56, the ducts 14, and ultimately the sound transducers 16 can be easily removed and reattached when the garment 12 is cleaned. Effectively, then, the system is modular, as sound transducers and/or ducts may be removed and replaced to customize the sound from the system to the particular needs of an individual wearer. Because the first duct 14*a* is integrally formed with the collar 32 of the jacket 12, it cannot be removed when laundered. Therefore, it is preferable that the first duct 14*a* and the first pair of sound transducers 16*a* be sealed in a membrane which passes air (sound) and not fluid such as GORTEX or formed from a waterproof material to prevent penetration by moisture. Alternatively, the collar 32 and the duct 14*a* may be provided with a mating means to facilitate removal of duct 14*a* and sound transducers 16*a*.

The jacket 12 of the first embodiment further includes a pair of pockets 60 near the wasteband 30 at least one of which is sized to hold a portable personal audio tape or CD player (e.g. a Sony® WALKMAN), DVD player, cell phone, or other type of audio source (not shown). The pockets 60, which are concealed within a lining of the jacket, are zippered to allow the wearer to have easy access to the player or other contents. Wires 64 attached to each of the sound transducers 16 run through the lining of the jacket to one of the pockets 60 and electrically connect to speaker jacks (not shown) which couple to the player.

A second embodiment of a personal wearable speaker system 110 which is substantially similar to the first embodiment 10 (with like parts having reference numerals incremented by 100), is shown in FIGS. 2*a*, 2*b*, 2*c*, and 2*d*. The second embodiment of the speaker system 110 is shown on a garment 112 and includes three tubular ducts 114*a*, 114*b*, 114*c* coupled to the garment 112, and three pair of sound transducers 116. Each of the ducts 114*a*, 114*b*, 114*c* has a first end 140*a*, 140*b*, 140*c* and a second end 142*a*, 142*b*, 142*c*, and each defines a chamber 138 therebetween. The sound transducers 116 are mounted in the ends 140*b*, 140*c*, and 142*b*, 142*c* of the first and second ducts 114*b*, 114*c*. In the second embodiment, it is preferable that the first duct 114*a* be smaller than the second and third ducts 114*b*, 114*c* and the second and third ducts 114*b*, 114*c* be substantially similar in size and shape. The dimensions of the first duct 114*a* are preferably 0.5 inches by one inch by fifteen inches, and the dimensions of the second and third ducts 114*b*, 114*c* are preferably two inches by two inches by twenty inches.

The first duct 114*a* of the second embodiment is preferably formed in or on the collar 132 of the jacket 112. The second and third ducts 14*b*, 114*c* cross from the front 118 to the back 124 of the jacket 112 across the shoulders 126 of the jacket 112. According to the second embodiment 110, all of the tubular ducts 114 are substantially cylindrical and have substantially circular cross-sections along their length 146. Therefore, the width and height dimensions (or tube diameters) of the ducts are substantially equivalent; i.e. each duct 114 may has a one to one width to height ratio. Sound transducers 116 mounted in the open ends 140, 142 in the first duct 114*a* direct soundwaves outward toward the ears of a wearer. Sound transducers 116 mounted in the open ends 140, 142 of the second and third ducts 114*b*, 114*c* project soundwaves inward toward a body of the wearer which imparts a vibrational component to the body of the wearer. The sound transducers 116 are mounted within the open ends 140, 142 of the ducts 114 by adhesive, double sided tape, pins, clips, or other such device or mechanism applied to the face plate 139 such that the transducer is securely held within the open ends even when the flexible duct is bent or flexed. Alternately, the sound transducers may be secured within the ends by friction fit. The vibrational component to the wearer of sound generated by the sound transducers 116 may further be enhanced and the sound transducers 116 protected by providing the jacket 112 with a perforated membrane 154 instead of a fabric lining at the location on the garment 112 adjacent the sound transducers 116. According to the second embodiment, sound ports 170 are defined in both the second and third ducts 14*b*, 114*c* near the shoulders 126 of the jacket 112. The sound ports 170 relieve back pressure from within the chambers 138 of the ducts 114 and vent soundwaves outward toward an ear of the wearer. In addition, the sound ports increase the low frequency output of the system.

As previously suggested, the first duct 114*a* may be formed into the collar 132 such that it cannot be removed, or may be placed on the collar via a zipper or other mating structure so that it can be removed. Where the first duct is removable, the speaker must either be provided with a receiver and a power source for wireless transmission from the player or wire contacts must be established at the mating structure to establish a connection between the player and the speaker. For example, a zipper half on the jacket may be electrically wired to the player and the zipper half on the removable collar section may be electrically wired to the speaker such that contact is established when the collar is attached to the jacket. In stereo, each zipper portion may be divided into two sections by a non-conductive tooth or set of teeth such that separate wires are run from the separate speakers to the separate zipper sections on the removable collar, and from the player to the separate sections of the jacket zipper portion.

The second and third ducts 14*b*, 114*c* are preferably detachably coupled to the jacket 112 by securing rings 158 coupled to the ducts 114 near the ends 140*b*, 140*c*, 142*b*, 142*c* of the ducts 14*b*, 114*c*. The securing rings 158 are secured to the ducts 14*b*, 114*c* via stitches, adhesives, double-sided tape or other securing mechanisms. The securing rings 158 are coupled to the jacket 112 (e.g. by stitches, adhesive, or double-sided tape) such that the ducts 114 and ultimately the sound transducers 116 can be easily removed and reattached. Further, the jacket 112 of the second embodiment preferably has a pair of external pockets 160 near the wasteband 130. The pockets 160 are preferably gusseted so that they can expand to provide extra room to hold larger personal audio systems or a larger number of CDs or cassettes. The pockets 160 have a flap 172 with a snap closure to secure the contents of the pockets 160 and to provide quick access to the audio player. Wires 166 attached to each of the sound transducers 116 run inside a lining of the jacket and terminate in jacks (not shown) which electrically connect the sound transducers 116 to the audio player.

Figure 3A:
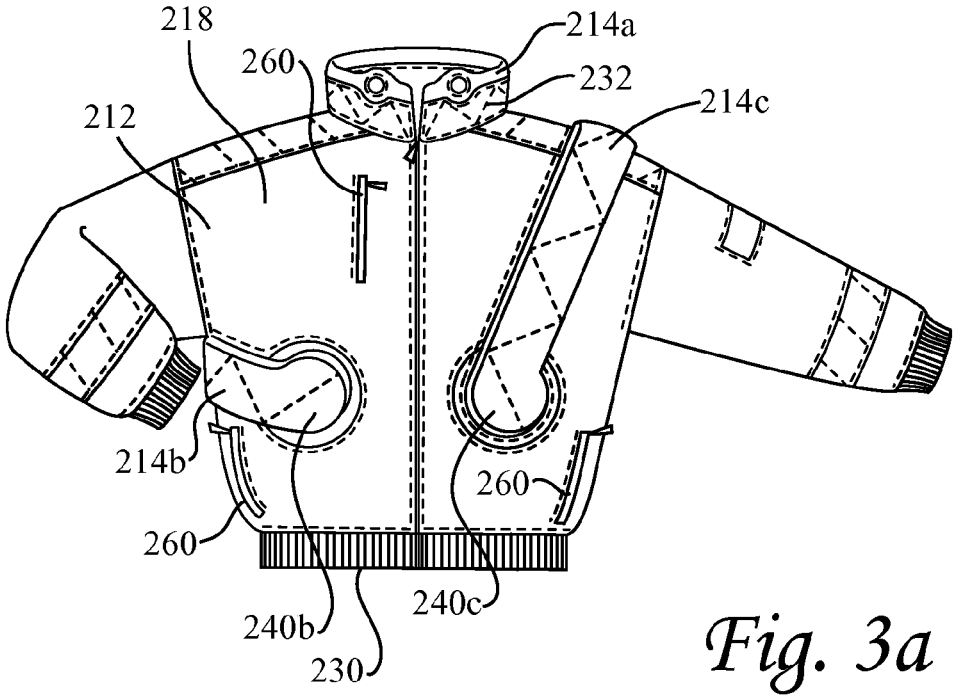
FIG. 3*a* is a perspective view of a front of a third embodiment of a personal wearable speaker system coupled to a garment.
Figure 3B:
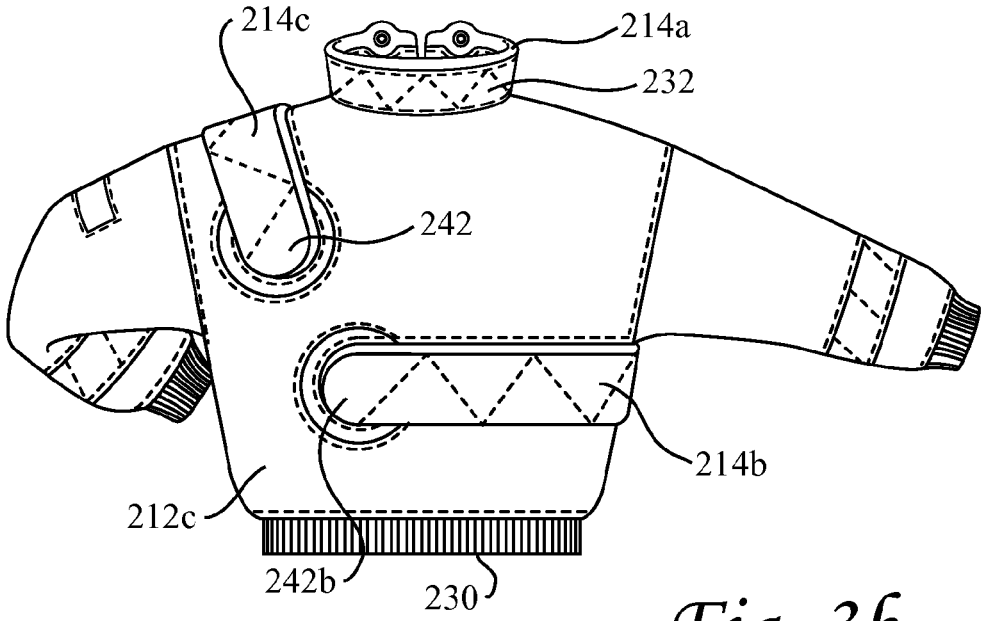
FIG. 3*b* is a perspective view of a back of the third embodiment of the personal wearable speaker system of FIG. 3*a;*

Turning now to FIGS. 3*a* and 3*b*, a third embodiment of a wearable speaker system 210, which is substantially similar to the first embodiment 10 (with like parts having reference numerals incremented by 200), is shown. The third embodiment of the speaker system 210 includes a garment 212 having three tubular ducts 214*a*, 214*b*, 214*c* coupled to the garment 212, and three pairs of sound transducers (not shown) coupled to the ducts 214. According to the third embodiment, the first duct 214*a* is formed and positioned on the jacket 212 similarly to the first duct 14*a* in the first embodiment 10. The third duct 214*c* is positioned across a shoulder 226 of the jacket 212 as described in previous embodiments. However, according to the third embodiment 210, the second duct 214*b* is positioned upon the jacket 212 such that it crosses from the first front panel 220 of the front 218 of the jacket 212 to the back 224 of the jacket 212 substantially beneath one of the pair of sleeves 228. The second and third ducts 214*b*, 214*c* have a first end 240*b*, 240*c* and a second end 242*b*, 242*c* and both define a chamber (not shown) therebetween. Further the ends of both the second and third ducts 214*b*, 214*c* either constitute or have defined therein a pair of transducer apertures (not shown) which open to the chambers. The transducer apertures and therefore the sound transducers can be advantageously positioned over particularly sensitive body organs (e.g. liver, kidneys, chest cavity) to enhance the vibratory response to the wearer. Further, according to the third embodiment 210, the first ends 240*b*, 240*c* of the second and third ducts 214*b*, 214*c* are larger than the second ends 242*b*, 242*c* to accommodate a larger low frequency sound transducer which provides an enhanced vibrational component. As with the previous embodiments, all of the ducts 214 of the third embodiment 210 preferably maintain a width to height ratio of no more than three to one.

According to the third embodiment 210, the jacket 212 is preferably provided with three zippered pockets 260, which are substantially concealed between the lining (not shown) and the outer surface of the jacket 212. The pockets 260 are positioned about the front 218 of the jacket 212 and include an upper pocket near the collar 232 and two lower pockets near the wasteband 230. As with previous embodiments, wires (not shown) attached to each of the sound transducers run inside the lining (not shown) of the jacket and electrically connect the sound transducers to the audio player. Each of the pockets 260 may be wired independently to provide multiple storage options for the audio player, giving the wearer the option of placing the audio player within the upper pocket thereby leaving the lower pockets near the wasteband 230 free to protect the wearer's hands or wallet. Alternately, just one of the pockets is selected for wiring.

A fourth embodiment of a personal wearable speaker system 310 coupled to a garment, which is substantially similar to the first embodiment 10 (with like parts having reference numerals incremented by 300), is shown in FIGS. 4*a*, 4*b*, and 4*c*. The fourth embodiment of the speaker system 310 includes the garment 312 having five tubular ducts 314*a*, 314*b*, 314*c*, 314*d*, 314*e* coupled to the garment 312, and five pairs of sound transducers 316, one pair of which is coupled to each of the ducts 314. As with the previous embodiments, the garment 312 of the fourth embodiment 310 is preferably a jacket 312 having a front 318 formed as a pair of front panels 320, 322, a back 324, a pair of shoulders 326 formed at the junction of the front 318 and back 324, a pair of sleeves 328, a wasteband 330, and a collar 332. According to the fourth embodiment 310, each of the tubular ducts 314 has a first end 340*a*, 340*b*, 340*c*, 340*d*, 340*e* and a second end 342*a* 342*b*, 342*c*, 342*d*, 342*e* and each defines a chamber (not shown) therebetween. Further, each of the ducts 314 defines a transducer aperture (not shown) near or at each of the ends 340, 342 which opens into the chambers.

Each of the ducts 314 of the fourth embodiment has substantially circular cross-sections along its length, thereby providing a width to height ratio of one to one for the ducts. In the fourth embodiment 310, it is preferable that the dimensions of the second 314*b*, third 314*c*, fourth 314*d*, and fifth 314*e* ducts be the same. The dimensions of the first duct 314*a* are preferably 0.5 inches by one inch by fifteen inches, the dimensions of the second and third ducts 314*b*, 314*c*, are preferably 0.75 inches by 0.75 inches by twenty inches, and the fourth, and fifth ducts 314*d*, 314*e* are preferably 0.75 inches by 0.75 inches by twenty-five inches.

According to the fourth embodiment 310, the first tubular duct 314*a* is formed by a collar 332 of the jacket 312 as described in previous embodiments. The four remaining tubular ducts 314*b*, 314*c*, 314*d*, 314*e* of the fourth embodiment are applied to the jacket 312 in pairs 314*b*, 314*c* and 314*d*, 314*e*. A first pair 314*b*, 314*c* are held in substantially parallel relation, and cross from the first front panel 320 to the back 324 over one shoulder 326 of the jacket 312. The other pair of ducts 314*d*, 314*e*, which are also held in substantially parallel relation, cross from the second front panel 322 to the back 324 across the other shoulder 326. As with previous embodiments, a sound transducer is mounted to each of the transducer apertures. The sound transducers are sized such that at least a portion of the transducer is housed within each of the chambers of the ducts 314. The sound transducers within the first duct 314*a* are preferably adapted to project a sound wave outward toward the ears of a wearer. Sound transducers within the other ducts 314*b*, 314*c*, 314*d*, 314*e* are positioned such that when the jacket 312 is being worn by a wearer, the sound transducers project soundwaves toward the body of the wearer thereby imparting a vibratory sensation to the body of the wearer. As described in a previous embodiment, the precise positioning of the transducers and the ducts may be influenced by the desire to locate the sound transducers near specific sensitive body organs which will enhance the vibratory response. However, it will be appreciated that the location of the sound transducers and therefore the ducts 314 on the garment 312 may also be totally or partially influenced by aesthetics, i.e., it may be aesthetically desirable to either position some of the plurality of ducts 314 adjacent one another or instead randomly place them about the jacket 312 such that they crisscross. Further, the vibrational component may be enhanced and the sound transducer protected by providing the jacket with a perforated membrane 354 at the locations on the jacket adjacent the sound transducers. As with previous embodiments, securing rings 358 coupled to the ducts 314*b*, 314*c*, 314*d*, 314*e* near the ends 340*b*, 340*c*, 340*d*, 340*e*, and 342*b*, 342*c*, 342*d*, 342*e* may be used to facilitate the connection between the ends 340*b*, 340*c*, 340*d*, 340*e*, and 342*b*, 342*c*, 342*d*, 342*e* and the jacket 312. Alternately or additionally, decorative securing strips 376 may be attached to the jacket 312 across the ducts 314*b*, 314*c*, 314*d*, 314*e* to both secure the ducts to the jacket and to provide an aesthetic element to the design of the garment.

In an alternate fourth embodiment shown in FIG. 4*d*, either the first pair 314*b*, 314*c* or second pair of tubular ducts (not shown) may be coupled to the sound transducer 316 such that the pair is coupled to only one sound transducer 316 which is adapted to sit adjacent the pair of ducts. The single transducer 316 can thereby utilize both chambers 338*b*, 338*c* effectively creating a dual chambered speaker enclosure.

The jacket 312 of the fourth embodiment 310 further includes a snap or button front fastener 334 and has no external pockets. Instead, an internal pocket (not shown) is provided to house the audio player. As previously described, wires (not shown) attached to each of the sound transducers run through a lining of the jacket and electrically connect the sound transducers to the player.

Figure 5A:
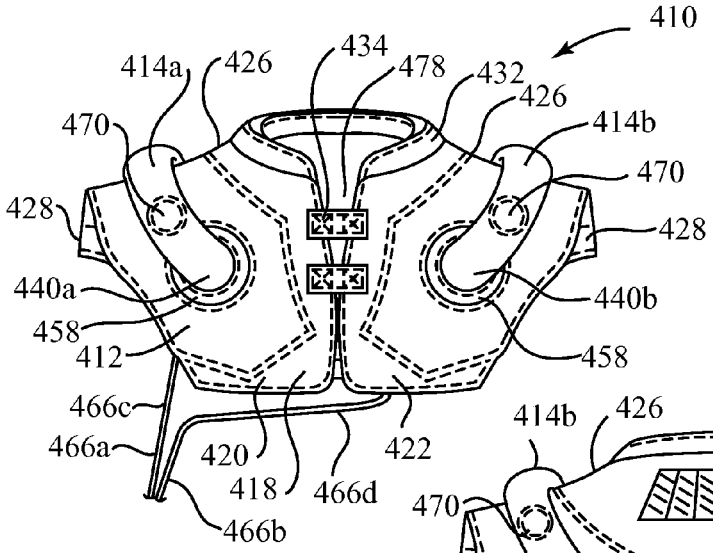
FIG. 5*a* is a perspective view of a front of a fifth embodiment of a personal wearable speaker system coupled to a garment.
Figure 5B:
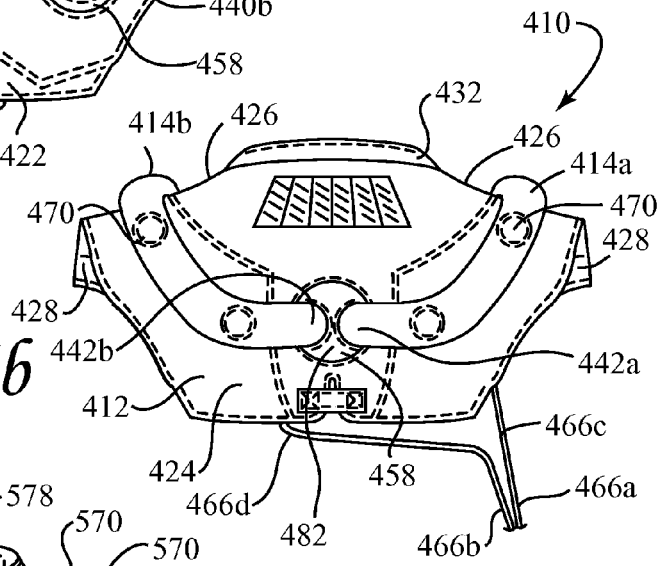
FIG. 5*b* is a perspective view of a back of the fifth embodiment of the personal wearable speaker system of FIG. 5*a;*

Turning now to FIGS. 5*a* and 5*b*, a fifth embodiment of a personal wearable speaker system 410 coupled to a garment 412, which is substantially similar to the first embodiment 10 (with like parts having reference numerals incremented by 400), is shown. The fifth embodiment of the speaker system 410 includes a garment 412 having a pair of cylindrical tubular ducts 414*a*, 414*b* coupled to the garment 412, and two pair of sound transducers (not shown) coupled to the ducts 414. The garment 412, which is preferably a vest or a shirt, includes a front 418 formed as a pair of front panels 420, 422 defining a front opening 478 in the garment 412, a back 424, a pair of shoulders 426 formed at the junction of the front 418 and back 424, a pair of sleeves 428, and a collar 432. A pair of hook and loop type fasteners 434 (e.g. VELCRO strips) sewn onto the front panels 420, 422 detachably connect the front panels 420, 422 and secure the front opening 478. According to the fifth embodiment, each of the tubular ducts 414*a*, 414*b* has a first end 440*a*, 440*b* and a second end 442*a*, 442*b* and each defines a chamber (not shown) within the ducts 414. Further, each of the ducts 414 defines a transducer aperture (not shown) at or near each of the ends 440 which opens into the chambers. As with the previous embodiments, each of the tubular ducts 414 has a length, a width, and a height, and a width to height ratio preferably of not more than three to one. Because the tubular ducts 414 of the fifth embodiment 410 are substantially cylindrical, the second and third dimensions are substantially equivalent thereby providing a one to one width to height ratio. In the fifth embodiment 410, it is preferable that the dimensions of the first and second ducts 414*a*, 414*b* be identical. Preferred dimensions are 1.5 inches by 1.5 inches by twenty-five inches.

A sound transducer is mounted within each of the transducer apertures in the ducts. Further, each of the tubular ducts 414 defines a plurality of sound ports 470 spaced along its length. As previously described in the first embodiment, both ducts 414*a*, 414*b* cross from the front 418 to the back 424 of the garment 412 across a shoulder 426 of the garment 412. Each of the ducts 414*a*, 414*b* of the fifth embodiment 410 are positioned on the garment 412 such that the first ends 440*a*, 440*b* align centrally upon one of the front panels 420, 422. The second ends 442*a*, 442*b* of the ducts 414 are centrally located and aligned on opposing sides of a centerline 482 of the back 424 of the garment 412. The centerline 482 also corresponds to a location adjacent a spinal column of a wearer. As previously described, securing rings 458 attach near the ends 440*a*, 440*b*, 442*a*, 442*b* of the ducts 414*a*, 414*b* and help detachably secure the ducts 414*a*, 414*b* to the garment 412. As shown in FIG. 5*b*, a single securing ring 458 secures both second ends 442*a*, 442*b* of the ducts 414*a*, 414*b* to the garment 412. In the fifth embodiment 410, no pocket or other carrying aid is provided to accommodate the audio player. The player can instead be held by the wearer or otherwise secured to another garment of the wearer. Wires 466*a*, 466*b*, 466*c*, and 466*d* are attached to the sound transducers, run along an inside of the back 424 of the garment 412, and electrically connect the sound transducers to the player which is located elsewhere.

Figure 6A:
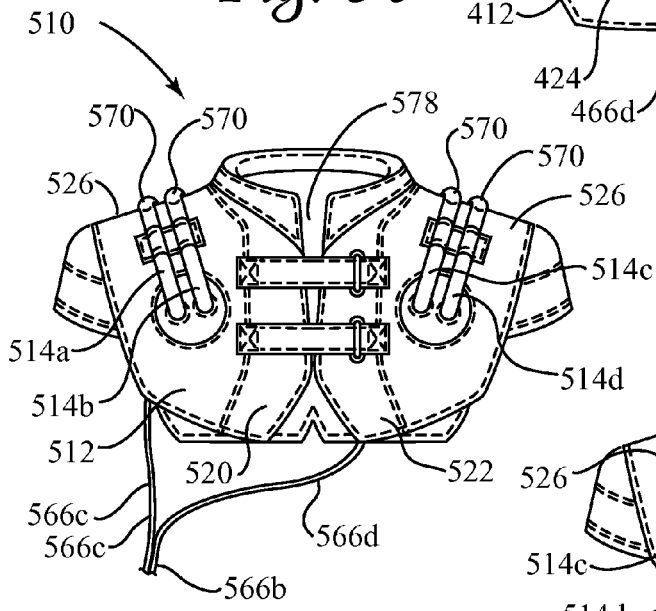
FIG. 6*a* is a perspective view of a front of a sixth embodiment of a personal wearable speaker system coupled to a garment.
Figure 6B:
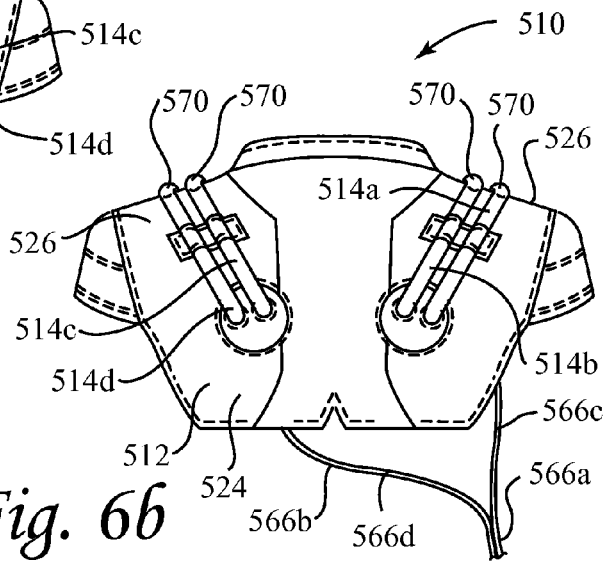
FIG. 6*b* is a perspective view of a back of the sixth embodiment of the personal wearable speaker system of FIG. 6*a;*
Figure 7A:
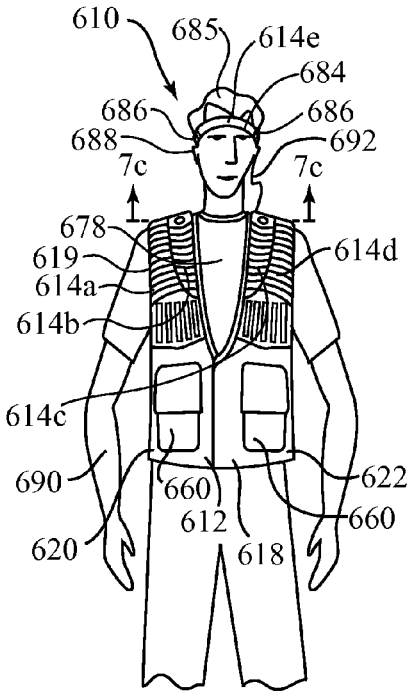
FIG. 7*a* is a perspective view of a front of a seventh embodiment of a personal wearable speaker system coupled to a vest being worn by a wearer.
Figure 7B:
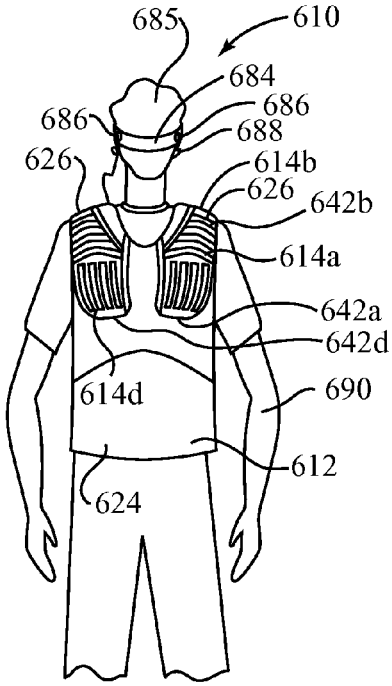
FIG. 7*b* is a perspective view of a back of the seventh embodiment of the personal wearable speaker system of FIG. 7*a* being worn by a wearer.

As seen in FIGS. 6*a* and 6*b*, a sixth embodiment of a personal wearable speaker system 510 coupled to a garment 512, which is substantially similar to the first embodiment 10 (with like parts having reference numerals incremented by 500), is shown. The sixth embodiment of the speaker system 510 includes a garment 512 having four tubular ducts 514*a*, 514*b*, 514*c*, 514*d* coupled to the garment 512 in pairs (514*a*, 514*b* & 514*d*, 514*d*), and four pairs of sound transducers (not shown) coupled to the ducts 514. The garment 512 is preferably a vest or shirt similar to the garment in FIGS. 5*a* and 5*b*. The four substantially cylindrical tubular ducts 514*a*, 514*b*, 514*c*, 514*d* each have a first end 540*a*, 540*b*, 540*c*, 540*d* and a second end 542*a*, 542*b*, 542*c*, 542*d* defining a chamber (not shown) and each defining a pair of transducer apertures (not shown) opening into the chamber. As with the previous embodiments, the tubular ducts 514 of the sixth embodiment 510 preferably maintain a width to height ratio of no more than three to one. In the sixth embodiment 510, it is preferable that the dimensions of each of the ducts 514*a*, 514*b*, 514*c*, 514*d* be equivalent. The dimensions of the ducts 514 are preferably 0.75 inches by 0.75 inches by twenty inches. As with the fourth embodiment, the first pair of ducts 514*a*, 514*b* are aligned in a substantially parallel relation and cross from the first front panel 520 to the back 524 of the garment 512 across one shoulder 526 of the garment 512. The second pair of ducts 514*c*, 514*d* are also aligned in a substantially parallel relation and cross from a second front panel 522 to the back 524 of the garment 512 across another shoulder 526 of the garment 512.

Sound transducers are at least partially housed within the transducer apertures such that soundwaves emanating therefrom are projected toward a body of a wearer enhancing the low frequency response. The vibrational component may be further enhanced by providing a perforated membrane at the locations on the garment adjacent the sound transducers. Sound ports 570, defined by the ducts 514 near the shoulders 526 of the garment 512, help relieve back pressure within the chambers and also project soundwaves outward toward an ear of the wearer. As in the fourth embodiment 310, securing strips 576 sewn onto the garment 512 about each of the pair of ducts 514*a*, 514*b*, and 514*c*, 514*d* may be used to secure the ducts to the garment 512 and/or may be used primarily for aesthetic decoration. As in the fifth embodiment 410, the garment 510 does not have a pocket to hold an audio player. Instead wires 566*a*, 566*b*, 566*c*, and 566*d* attached to each of the sound transducers run along an inside of the back 524 of the garment 512 and electrically connect the sound transducers to the player which is preferably contained elsewhere on the person of the wearer.

Turning now to FIGS. 7*a*, 7*b*, 7*c*, and 7*d*, a seventh embodiment of a personal wearable speaker system 610 coupled to a garment, which is substantially similar to the first embodiment 10 (with like parts having reference numerals incremented by 600), is shown. The speaker system 610 includes a garment 612, two pair of relatively flat ducts 614*a*, 614*b*, and 614*c*, 614*d* attached to the garment 612, and a plurality of sound transducers 616 coupled to the ducts 614. According to the seventh embodiment, the relatively flat ducts are preferably formed as open back ducts which are preferably provided with undulating surfaces 619 as disclosed in U.S. Pat. No. 6,438,249 to Wiener, which is incorporated by reference herein in its entirety. Preferably, the open back ducts are coupled in pairs to mating receptacles 615*a*, 615*b* (better shown in FIG. 7*c*) attached to the garment. With an open back duct, the garment and the duct together define a chamber therebetween. The paired multichannel ducts (i.e., one channel per duct) provide separate chambers for separate high and low frequency transducers. In the seventh embodiment, the ducts 614 may be formed into any shape or size and may vary in cross-sectional shape along their length. The undulating surfaces 619 aid sound flow through the chambers and prevent chamber pinch off. Where the flexible ducts are provided with undulating surfaces, there is no need to limit the width to height to a maximum 3:1 ratio for each of the ducts, as the undulations help prevent the ducts from being pinched off.

According to the seventh embodiment 610, the garment 612 is a vest having a front 618 formed as a pair of front panels 620, 622 defining an opening 678 therebetween, a back 624, a pair of shoulders 626 formed at the junction of the front 618 and the back 624, and a pair of pockets 660 each attached to one of the pair of front panels 620, 622. Each of the ducts 614*a*, 614*b*, 614*c*, 614*d* has a first end 640*a*, 640*b*, 640*c*, 640*d* and a second end 642*a*, 642*b*, 642*c*, 642*d* and each defines a chamber 638*a*, 638*b*, 638*c*, 638*d* between the duct and the garment. Further, each of the ducts 614 define at least one transducer aperture 644*b*, 644*c* (644*a*, 644*d* not shown) which opens into the chambers 638.

According to the seventh embodiment 610, the ducts 614 are preferably mounted to the vest in pairs 614*a*, 614*b*, and 614*c*, 614*d* each pair having an innermost duct 614*b*, 614*c* and an outermost duct 614*a*, 614*d* (relative to the neck). Each pair of ducts directly crosses one of the shoulders 626 of the vest from the front 618 to the back 624 such that the first ends 640 are coupled to one of the front panels 630, 622 and the second ends 642 are coupled to the back 624. Although preferably attached to the garment by receptacles, the ducts may instead attach by being sewn, snap fastened, or being seated in/on a retaining grommet. The two pair of ducts may be integrally formed as shown or may be independent of one another. Transducer apertures 644*a*, 644*b* are defined in the innermost ducts 614*b*, 614*c* near the shoulders 626 of the garment 612. Transducer apertures (not shown) are defined in the outermost ducts 614*a*, 614*d* directly above particular body organs. Sound transducers 644*a*, 644*b* mounted within the innermost ducts 614*b*, 614*c* project sound outward toward the ears 688 of the wearer 690. Sound transducers in the outermost ducts 614*a*, 614*d* are mounted in the transducer apertures directly above particularly sensitive body organs to provide a vibrational component to a body 693 of the wearer 690 which enhances the perception of the low frequency sound component. Additionally, the vibrational component may be enhanced and simultaneously the sound transducer protected by providing the garment fabric with a perforated membrane 654 at the location on the garment 612 adjacent the sound transducers. The pair of external pockets 660 provided on the front 618 of the vest 612 are adapted to house an audio player. However, it is understood that the player may instead be carried by the wearer 690 or be secured to another article of clothing. Wires 666 attached to each of the sound transducers 616 run along an inside of the vest 612 or within an internal lining of the vest and electrically connect the sound transducers 616 to the audio player.

Figure 7D:
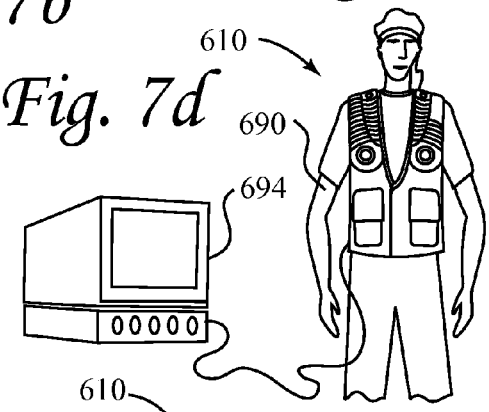
FIG. 7*d* is a perspective view of the seventh embodiment of a personal wearable speaker system of FIG. 7*a* wired to an entertainment system.

If desired, a duct 614*e* with a pair of sound transducers 686 attached thereto may be provided on a headband 684 adapted to be worn about a head 685 of a wearer 690. The sound transducers are aligned adjacent one of the ears 688 of the wearer 690. A wire 692, which runs adjacent the head 685 of the wearer 690 down to the shoulder 626 of the vest 612, is provided to electrically connect the sound transducers 686 on the headband 684 to the player contained on the vest 612. Referring specifically to FIG. 7*d*, the speaker system 610 may instead be wired to an audio/video device 694 (e.g. a television) to provide personal stereophonic sound while the wearer 690 is viewing a video display and/or listening to music.

Figure 8A:
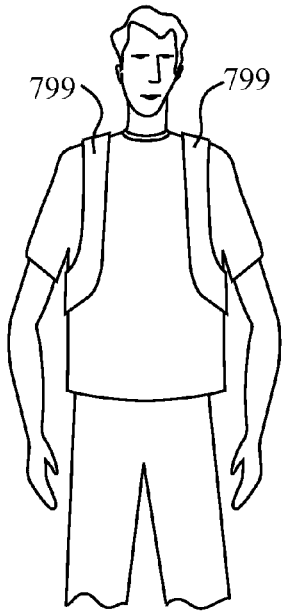
FIG. 8*a* is a perspective view of a front of an eighth embodiment of a personal wearable speaker system coupled to a backpack being worn by a wearer.
Figure 8B:
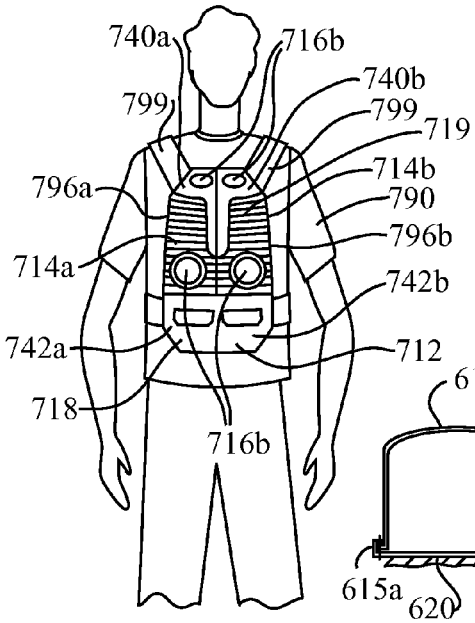
FIG. 8*b* is a perspective view of a back of the eighth embodiment of the personal wearable speaker system of FIG. 8*a* being worn by a wearer.
Figure 7C:
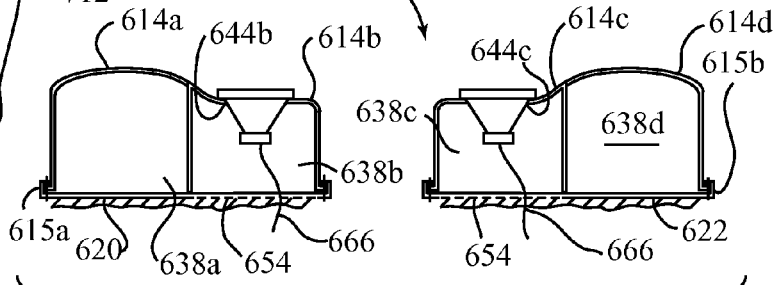
FIG. 7*c* is a cross-sectional view of a pair of ducts of the seventh embodiment FIG. 7*a* taken along line 7*c*-7*c;*

Turning now to FIGS. 8*a* and 8*b*, an eighth embodiment of a personal wearable speaker system 710 coupled to a backpack 712, which is substantially similar to the seventh embodiment 610 (with like parts having reference numerals incremented by 100), is shown. The speaker system 710 includes the backpack 712, two relatively flat ducts 714*a*, 714*b* having undulating surfaces 719 and being coupled to the backpack 712, and a pair of sound transducers 716*a*, 716*b* coupled to each of the ducts 714*a*, 714*b*. According to the eighth embodiment, the backpack 712 has a front 718, a back (not shown), and a pair of sides 796*a*, 796*b*, and defines a zippered compartment (not shown) substantially therebetween. Further, the backpack 712 has a pair of straps 799*a*, 799*b*. Each of the tubular ducts 714*a*, 714*b* attach to the front 718 of the backpack 712. Each duct 714*a*, 714*b* has a first end 740*a*, 740*b* and a second end 742*a*, 742*b* and defines a chamber (not shown) therebetween. The ducts 714*a*, 714*b* further define a pair of transducer apertures (not shown) which open to the chambers. The first transducer aperture is defined near the first end 740 of the ducts 714 and is adapted to house a high frequency sound transducer 716*a*. The second transducer aperture is defined near the second end 742 is adapted to house larger low frequency transducers 716*b*. A sound transducer 716 is mounted to each of the transducer apertures such that soundwaves from the high frequency transducers 716*a* project outward toward an ear 788 of a wearer 790 and soundwaves from the low frequency transducers 716*b* project soundwaves inward toward a body 793 of the wearer 790. The zippered compartment (not shown) is adapted to house an audio player. Wires (not shown) attached to each of the sound transducers 716*a*, 716*b* connect to speaker jacks which run along an inside of the backpack 712 and electrically connect the sound transducers to the player contained therein.

Figure 9A:
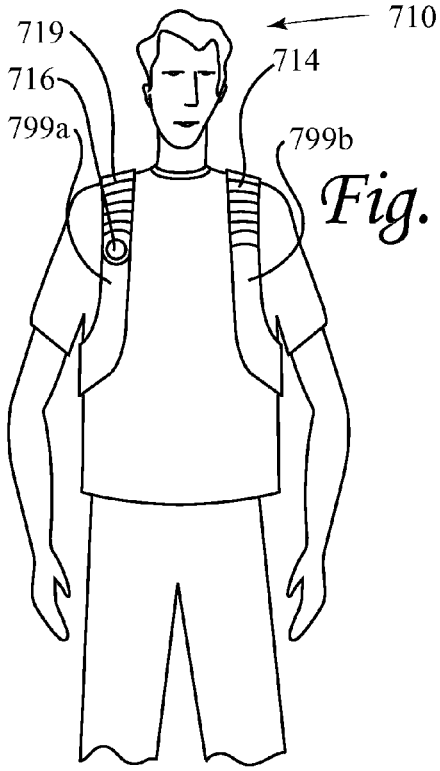
FIG. 9*a* is a perspective view of a front of an alternate eighth embodiment of a personal wearable speaker system coupled to a backpack being worn by a wearer.
Figure 9B:
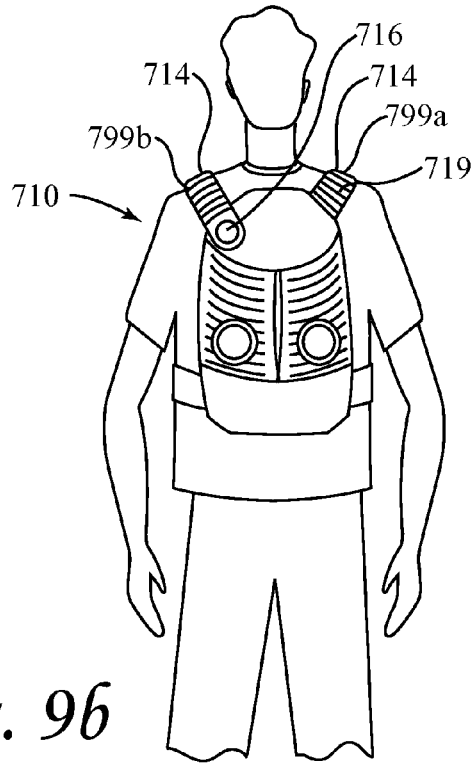
FIG. 9*b* is a perspective view of a back of the alternate eighth embodiment of the personal wearable speaker system of FIG. 9*a* being worn by a wearer.

If desired, the backpack of FIG. 8*a* and 8*b*, as shown in an alternate eighth embodiment 710 shown in FIGS. 9*a* and 9*b*, can be provided with straps 799*a*, 799*b* which are themselves provided with a duct 714 and a transducer 716. The ducts 714 may be tubular or have undulating surfaces 719 as described previously.

Figure 10A:
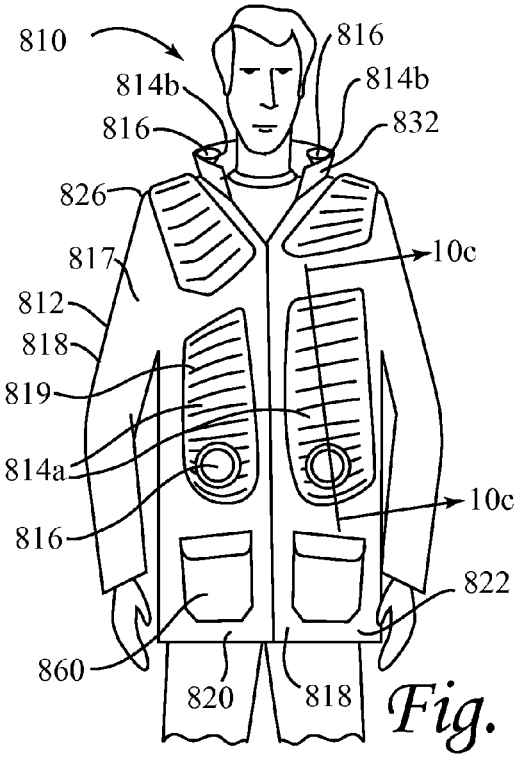
FIG. 10*a* is a perspective view of a front of a ninth embodiment of a personal wearable speaker system coupled to a coat being worn by a wearer.
Figure 10B:
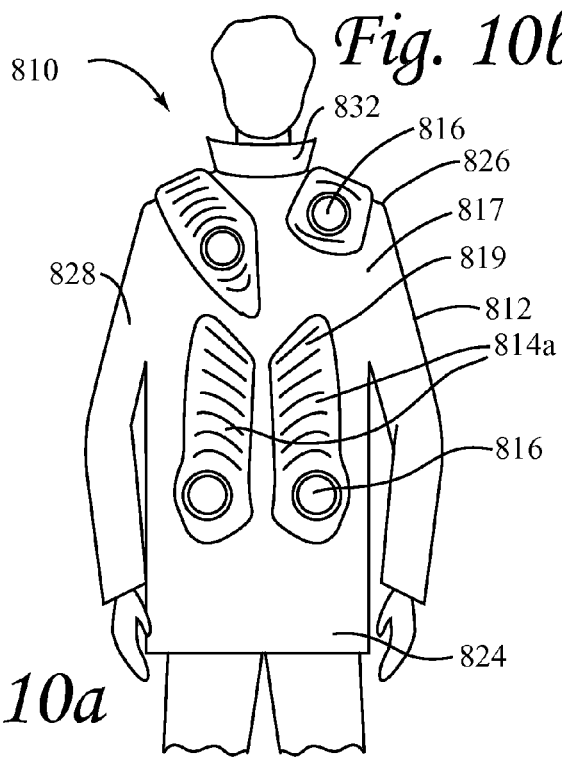
FIG. 10*b* is a perspective view of a back of the ninth embodiment of the personal wearable speaker system of FIG. 10*a* being worn by a wearer.
Figure 10C:
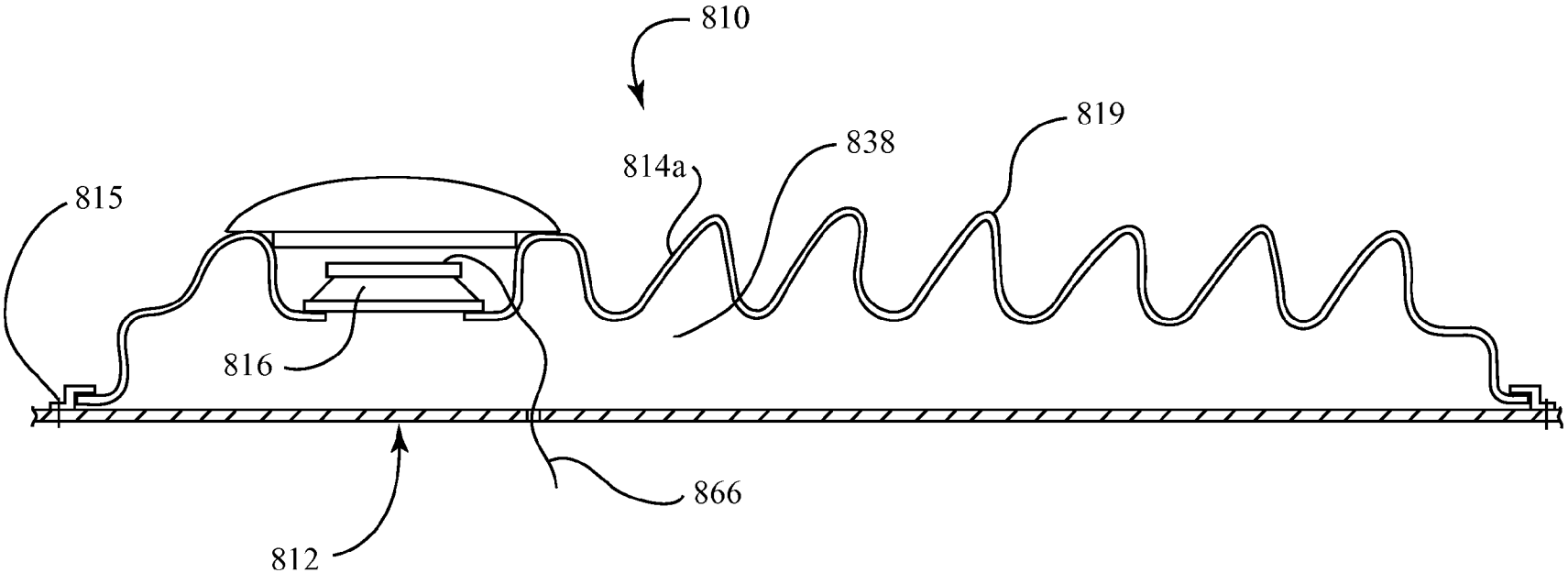
FIG. 10*c* is a cross-sectional view taken along line 10*c*-10*c* of FIG. 10*a*.

A ninth embodiment of a personal wearable speaker system 810 coupled to a garment, which is substantially similar to the seventh embodiment 610 (with like parts having reference numerals incremented by 200), is shown in FIGS. 10*a*, 10*b*, and 10*c*. The speaker system 810 includes a garment 812, a plurality of relatively flat ducts 814*a* attached to the garment 812, a pair of tubular ducts 814*b* coupled elsewhere to the garment 812, and a plurality of sound transducers 816 each coupled to one of the ducts 814*a*, 814*b*. According to the ninth embodiment 810, the garment 812 is a coat having a front 818 formed as a first front panel 820 and a second front panel 822, a back 824, a pair of shoulders 826 formed at a junction of the front 818 and back 824, a pair of sleeves 828 and a collar 832. Buttons, a zipper, or other type of fastener (not shown) may detachably couple the front panels 820, 822. The garment 812 may also be provided with interior and/or exterior pockets 860. The relatively flat ducts 814*a* are preferably formed as open back ducts which are preferably provided with undulating surfaces 819. The open back ducts 814*a* form substantially hollow chambers 838 when mated with the exterior surface 817 of the garment 812. The ducts 814*a* may be formed into any shape or size and may vary in cross-sectional shape along their length. The undulating surfaces 819 aid sound flow through the chambers and prevent chamber pinch off. Because the ducts are provided with undulating surfaces, there is no need to provide the preferred width to height ratio of no more than three to one for each of the ducts, as the undulations help prevent the ducts from being pinched off. The ducts 814*a* are preferably coupled to receptacles 815 which are coupled to the garment 812 as disclosed in the parent application hereto.

As previously mentioned, the ducts 814*a* are preferably attached to an exterior surface 817 of the garment. The ducts 814*b* are preferably attached at the collar 832 and may be run either within the lining (not shown) of the garment 812 or along an interior surface (not shown). The ducts 814*b* may be tubular or any other shape which preferably maintains a width to height ratio of no greater than three to one in regions where the ducts 814*b* are most likely to be pinched off. As discussed in previous embodiments, the ducts 814*a* may be arranged on the garment such that some ducts 814*a* are completely on either one of the front panels 820, 822 or the back 824 of the coat 812. Alternatively, some of the ducts 814*a* may cross one of the shoulders 826 of the garment 812. Transducers 816 may be positioned in the ducts 814*a* such that they either face outward or inward as desired. Transducers 816 coupled to the tubular ducts 814*b* are preferably positioned such that they project sound upward toward an ear of a wearer. Wires 866 may be run from each of the transducers through a lining of the coat 812 to one of the pockets 860 which is preferably designed to house a player.

There have been described and illustrated herein several embodiments of a personal wearable speaker system. While particular embodiments of the invention have been described, it is not intended that the invention be limited thereto, as it is intended that the invention be as broad in scope as the art will allow and that the specification be read likewise. While particular types of garments have been disclosed, it will be understood that the personal wearable speaker system may be applied to other types of garment as well; for example, and not by way of limitation, pants, shirts, blouses, t-shirts, sweat shirts, tank-tops, shawls, scarves, sweater, and capes. Likewise, while garments having a front formed by two front panels were disclosed, it will be appreciated that a garment may instead have a single front panel. While particular types of players have been disclosed, it will be appreciated that other types of sound sources could be adapted for use with this system as well. Further, while the transducers and the player are described as being wired together, it will be appreciated that the signal from the player may be received by other "wireless" means. It will also be appreciated that the ducts and sound transducers may be interchangeable modular features which a wearer buys, installs, and replaces at different times to customize the personal wearable sound system and that only one duct housing one transducer need be provided. Moreover, while particular duct arrangements on a particular type garment were disclosed, it will be appreciated that similar type garments could have one or more ducts arranged differently. Also, while externally mounted tubular ducts have been disclosed, it will be appreciated that the personal wearable speaker system could instead be provided with internally mounted ducts. Moreover, while ducts having particular dimensional size, shape or cross-section have been disclosed, it will be appreciated that ducts having different dimensional sizes, shapes, or cross-sections may likewise be used. It will likewise be appreciated that each of the ducts in a speaker system may have a different size, shape, or cross-section from all other ducts in the system. Further, it will be appreciated that the cross-section of any of the ducts may change along a length of the ducts. While substantially flat flexible ducts having undulating front surfaces and open backs were disclosed, it will be appreciated that the substantially flat ducts may be formed having closed backs as long as at least a portion of the duct most subjected to punch-off forces has undulations. Additionally, it will be appreciated that the tubular ducts may be used in combination with the substantially flat ducts on the same garment. It will also be appreciated that at least a portion of the ducts need not be flexible. While particular means of attachment of the ducts to the garment have been disclosed, it will be appreciated that other attachment means may be utilized as well including but not limited to adhesive, quick-release hardware, and magnets. Further, it will be appreciated that the ducts may be adapted to house one or more sound transducers. Also, sound transducers can include but are not limited to speaker drivers having a cone and magnet and membrane speakers. Furthermore, while it is preferred that the high frequency sound transducers be mounted near an ear of a wearer, it will be appreciated that the high frequency sound transducers may be mounted anywhere on the system. It will therefore be appreciated by those skilled in the art that yet other modifications could be made to the provided invention without deviating from its spirit and scope as claimed.

The invention claimed is:

1. A backpack speaker system, comprising:

a) a backpack including a first elongate duct having a first end and a second end attached to said backpack, said first duct defining a first duct chamber and adapted to flex without pinching off said first duct chamber;

b) a first sound transducer mounted to said first end of said first duct; and c) a second sound transducer mounted to said second end of said first duct.

2. A backpack speaker system according to claim 1, wherein:

said first duct is substantially round in cross-section.

3. A backpack speaker system according to claim 1, wherein:

said second sound transducer is configured on said backpack to face inward toward a body of the wearer of said backpack when said backpack is worn.

4. A backpack speaker system according to claim 3, wherein:

said first sound transducer faces outward toward an ear of the wearer.

5. A backpack speaker system according to claim 1, further comprising:

d) a second duct having a first end and a second end attached to said backpack, said second duct defining a second duct chamber;

e) a third sound transducer mounted to said first end of said second duct; and f) a fourth sound transducer mounted to said second end of said second duct.

6. A backpack speaker system according to claim 5, wherein:

said second duct is adapted to flex without pinching off said second duct chamber.

7. A backpack speaker system according to claim 5, wherein:

said second duct is substantially round in cross-section.

8. A backpack speaker system according to claim 5, wherein:

said second and fourth sound transducers are configured on said backpack to face inward toward a body of the wearer of said backpack when said backpack is worn.

9. A backpack speaker system according to claim 1, further comprising:

means for electrically coupling said sound transducers to an audio player.

10. A backpack speaker system according to claim 1, wherein:

said first duct has a length and varies in cross-sectional shape along said length.

11. A backpack speaker system according to claim 1, wherein:

said backpack includes at least one strap sized and configured for attaching the backpack to a wearer.

12. A backpack speaker system, comprising:

a) a backpack having a side;

b) a first duct attached to said side of said backpack, said first duct having a first end and a second end, said first duct defining a first chamber and adapted to flex without pinching off said first duct chamber;

c) a second duct attached to said side of said backpack opposite said first duct, said second duct having a first end and a second end, said second duct defining a second chamber;

d) a first sound transducer mounted to said first duct adjacent said first end of said first duct;

e) a second sound transducer mounted to said first duct adjacent said second end of said first duct;

f) a third sound transducer mounted to said second duct adjacent said first end of said second duct; and g) a fourth sound transducer mounted to said second duct adjacent to said second end of said second duct.

13. A backpack speaker system according to claim 12, further comprising:

means for electrically coupling said sound transducers to an audio player.

14. A backpack speaker system according to claim 12, wherein:

said first duct has a length and varies in cross-sectional shape along said length.

15. A backpack speaker system according to claim 12, wherein:

said backpack includes at least one strap sized and configured for attaching the backpack to a wearer.

* * * * *